US005221093A

United States Patent [19]

Adams

[11] Patent Number: 5,221,093

[45] Date of Patent: Jun. 22, 1993

[54] GAME APPARATUS

[76] Inventor: Troy E. Adams, 3540 Nicklaus Dr., Titusville, Fla. 32780

[21] Appl. No.: 806,255

[22] Filed: Dec. 13, 1991

[51] Int. Cl.[5] ..... A63F 9/00; A63F 9/06

[52] U.S. Cl. ..... 273/429; 273/118 R; 273/153 R; 273/113

[58] Field of Search ..... 273/108, 113, 115, 116, 273/118, 153 R, 429; 70/286, 289, 290, DIG. 44

[56] References Cited

U.S. PATENT DOCUMENTS

| | | | |
|---|---|---|---|
| 3,060,633 | 10/1962 | Glass et al. | 273/153 R |
| 3,532,343 | 10/1970 | Eggers | 273/153 R |
| 4,136,542 | 1/1979 | Robison | 273/153 R X |
| 4,208,052 | 6/1980 | Snow | 273/113 |
| 5,090,699 | 2/1992 | Friedman | 273/118 X |

*Primary Examiner*—V. Millin
*Assistant Examiner*—Raleigh W. Chiu
*Attorney, Agent, or Firm*—William M. Hobby, III

[57] ABSTRACT

A combination game apparatus is provided having a housing with a plurality of settable dials each having indicia thereon. Setting the correct combination on the game dials provides an output for indicating when a correct input combination has been set on the settable dials. The combination setting members are used for changing the combination necessary to indicate the correct input combination for unlocking the combination. The combination setting system includes a plurality of input members each having a combination setting, such as a coded opening in a flat card. Each combination setting member is placed in a covering sleeve so that it may be inserted into the game apparatus from the covered sleeves so that the combination being set cannot be seen by the players. The game may include a ball which is raised in a lift and dropped into a ball track where it passes through an opening in the track as determined by the first dial which determines which of a plurality of ball chutes the ball will move in. Selecting the right track allows the ball to pass through the opening in the combination setting member and proceed to the next dial settable ball track having an opening therethrough to select a second chute of a set of chutes so that selecting the correct chute will feed the ball to the coded opening in the second combination setting flat plate and allow the ball to continue selecting the correct combination which unlocks the combination lock.

19 Claims, 2 Drawing Sheets

GAME APPARATUS

BACKGROUND OF THE INVENTION

The present invention relates to a game apparatus and especially to a game apparatus having a combination game which uses combination setting members for changing the correct combination. The combination can be set without the players knowing the combination.

In the past, a wide variety of games including guessing games have been provided and these include many types of apparatus for playing games. Typical board games have spinning wheels or dice and the like and typically use cards and have various rules for playing the games. There are also many electronic type games which use computer circuitry including microprocessors and stored memory to play a game on a CRT using joysticks or controls. These type of games are typically used in arcades and may include coin boxes and the like. The present game relates to a combination game in which each player guesses the digits of a combination and, if all of the digits are selected to select the proper combination, a door can be opened or some other indication that the correct combination has been selected. The game utilizes a ball running on selected ones of a plurality of ball chutes with means to select the chute for the ball which cannot pass down the chute to the next selected combination unless the first correct chute has been selected. The ball travels down a series of ball chutes, each one of which can be selected from one of a plurality of chutes and a wrong selection returns the ball without completing the full combination circuit and requires the player to start over.

Prior art U.S. patents showing guessing games or games using balls and tracks can be seen in the Peter et al. U.S. Pat. No. 2,245,156 for a game of skill which uses automatic delivery of coins through a passageway and enables the player to affect mechanical settings of the device to various modes of playing a game of roulette or the like. The Dieball U.S. Pat. No. 3,982,764, is an electrical game apparatus of chance which includes a housing and display board using a plurality of display lights arranged to provide random symbols or numerals or letters and which game includes a rotatable mixer switch for varying the operation of the display lights with respect to the corresponding 4 switches. The Promin U.S. Pat. No. 3,610,628 is for a game apparatus having a plurality of number ring assemblies mounted vertically and rotatably on a shaft and each number ring assembly has a hole therethrough so that the assemblies can be rotated to any predetermined position which determines whether the ball is allowed to drop through one number ring assembly and out through a base to indicate a winner. The Pitkanen et al. U.S. Pat. No. 3,825,265, shows an amusement machine which has a vertically disposed playing surface such that perforated tokens or slugs are propelled upwards so as to descend into a plurality of slots or reservoirs. The Parks et al. U.S. Pat. No. 3,531,114 shows an electrical matching game apparatus using a series of electrical switches such that if correct selections are made, an electrical circuit is completed for dispensing tokens. The Kanno et al. U.S. Pat. No. 4,458,899, is a game capable of collecting and then randomly dispensing objects. The Boahn U.S. Pat. No. 4,542,688, is a container disposal apparatus which raises containers to an elevated position from which they can traverse a downwardly inclined chute where a rotatable interrupter plate, positioned in the chute's path, allows the containers to traverse the interrupter plate to trigger a prize dispensing mechanism.

In contrast, the present invention has means for changing the code each time a game is played such that the players cannot view or determine what the new combination is and then the game can be played by rotating dials which determine whether balls will traverse the ball tracks and chutes through the combination setting members to complete a complete circuit to give an indication of a successful setting of the combination.

SUMMARY OF THE INVENTION

A combination game apparatus is provided having a housing with a plurality of settable dials each having indicia thereon. Setting the correct combination on the game dials provides an output, such as the opening of a safe door, for indicating when a correct input has been set on the dials. The combination setting members are used for changing the combination necessary for opening the safe door. The combination setting system includes a plurality of combination input members each having a combination setting, such as an opening therethrough, in a predetermined place through a flat card. Each combination setting member is placed in a covering sleeve such that it may be inserted into the game apparatus from the covered sleeves so that the combination being set cannot be seen by any of the players. The game may include a ball which is raised in a lift to a top ball track where it passes through an opening in a ball track determined by one of the dials which determines which one of a plurality of ball chutes the ball enters. Selecting the right chute allows the ball to pass through the opening in the combination setting member and to proceed to the next settable ball track having an opening therethrough which is set by a second dial to select a second one of a set of chutes so that selecting the correct chute will feed the ball to the opening in the second combination setting member. Setting all of the combination dials correctly will allow the ball to go all the way through the game apparatus to unlock or indicate a correct combination setting.

BRIEF DESCRIPTION OF THE DRAWINGS

Other objects, features, and advantages of the present invention will be apparent from the written description and the drawings in which.

DESCRIPTION OF THE PREFERRED EMBODIMENT

Figure 1:
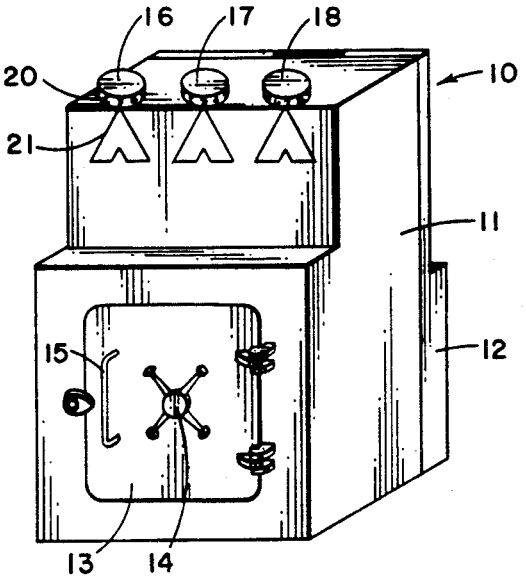
FIG. 1 is a front perspective view of a game apparatus in accordance with the present invention.
Figure 2:
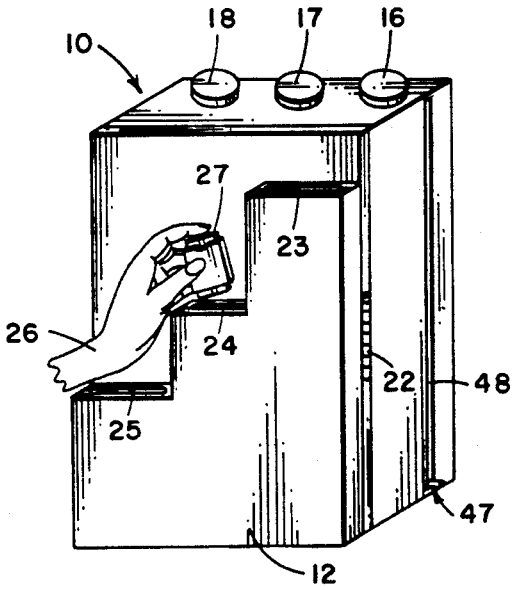
FIG. 2 is a rear perspective view of the game of FIG. 1.

Referring to the drawings and especially to FIGS. 1 and 2, a combination game 10 is shown having a housing 11 having a rear opening door 12 and a front safe-like door 13 having an emulated safe handle 14 and a door handle 15. The housing 11 can be seen having three dials 16, 17, 18 on the top thereof each having a plurality of indicia members 20 thereon for aligning the indicia with an arrow member 21. The door 12 can be seen to be hinged with a hinge 22 in FIG. 2 and has three slot openings 23, 24, 25 each associated with one of the dials 16, 17 and 18.

Figure 3:
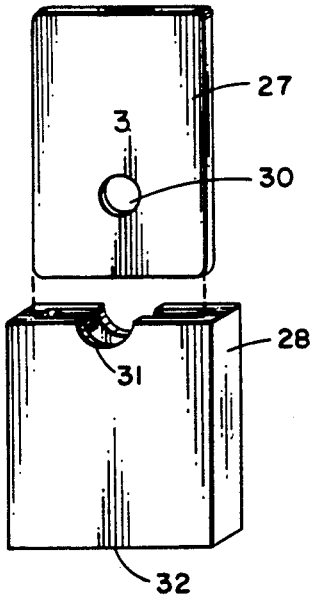
FIG. 3 is an exploded perspective view of a combination setting member in accordance with the present invention.

In FIG. 2, a player's hand 26 is inserting a combination setting member 27 into the slot 24. The combination setting member 27, as seen in FIG. 3, has been inserted into a sleeve 28 and the combination member 27 has an opening 30 set at a predetermined place on the flat surface of the member 27. Once inserted into the sleeve 28, the position of the opening 30 cannot be determined by the member who can then push the flat member 27 at the cutout 31 into the top of the slot 23, 24, or 25 where the combination setting member 27 can be released from the bottom 32 of the sleeve 28 to fall in the slot 23, 24, or 25 where it sets the combination number for one of the dials 16, 17 and 18 based on the alignment of the indicia 20 with the arrows 21.

Figure 4:
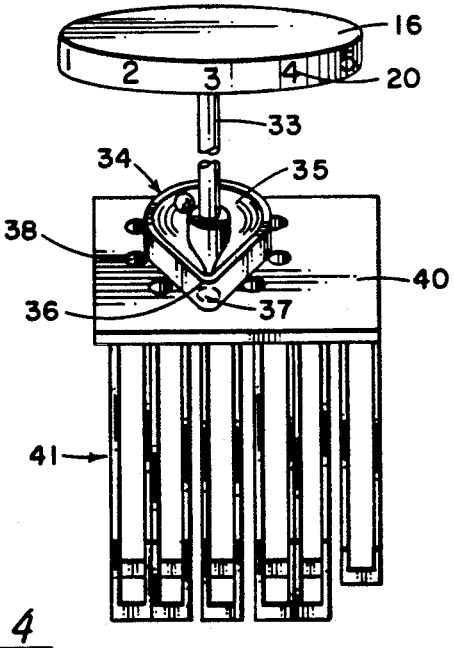
FIG. 4 is a perspective view of a dial assembly of the game of FIGS. 1 and 2.

The dials 16, shown in FIG. 4, can be seen having the indicia 20 thereon and connected to a rotatable shaft 33 which rotates a raceway ball track 34 having a track 35 looping around the shaft 33 and having a generally pointed portion 36 having an opening 37 therethrough which opening aligns with any one of a plurality of apertures 38 in a frame portion 40. Each aperture 38 aligns with a ball chute 41 so that rotating the dial 16 to align the indicia 20 aligns the raceway 34 opening 37 with one of the openings 38 connected to one of the chutes 41. As illustrated in FIG. 4, the numeral 3 is aligned with the third raceway which will feed through the combination block 27 of FIG. 3 opening 30 which is aligned for the number 3 chute.

Figure 5:
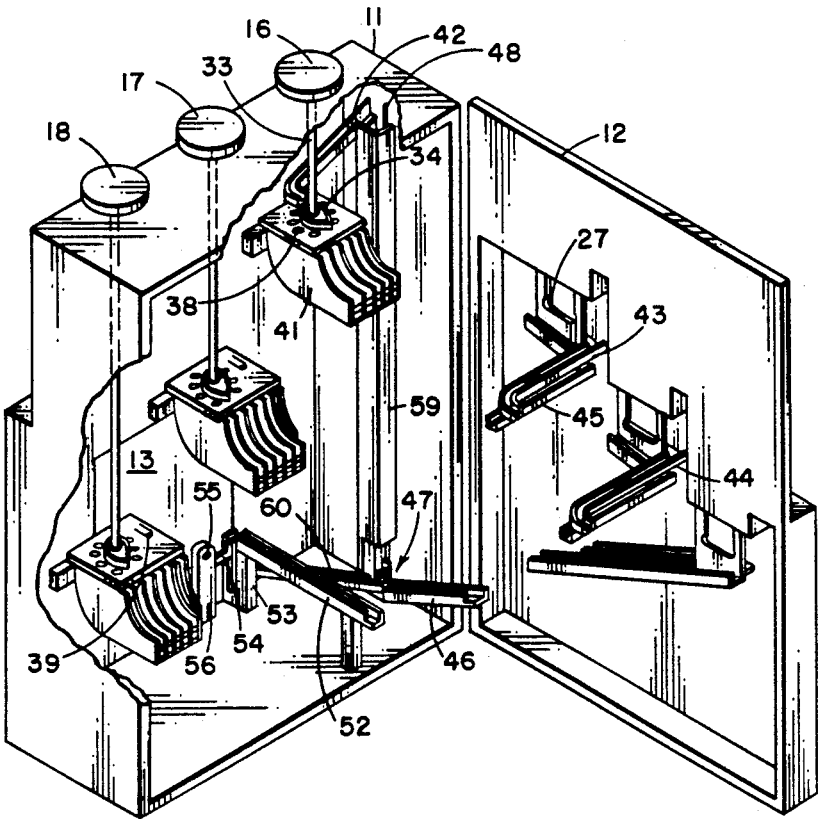
FIG. 5 is a cutaway perspective view of the game of FIGS. 1 and 2 having the back opened and portions removed.

As more clearly seen in FIG. 5, the dial 16 rotates the shaft 33 to rotate the raceway 34. A ball is fed into a chute 42 which feeds into the raceway 34 through the openings 37 and 38 into one of the ball chutes 41. When the door 12 is closed, the chutes 41 will abut against the combination cards 27 aligning one chute 41 with the opening 30. If the ball passes into the chute 41 and it happens to be aligned with the opening 30, the ball will continue therethrough and into a chute 43 where it will be fed into the next raceway 34 for the dial 17 which will operate in the same manner as for the dial 16 and feed the ball into one of a plurality of chutes which then feeds into a second chute 44, if the correct chute has been selected. If the wrong combination number has been selected on dial 17, the ball is fed down one of the chutes 41 which is not the correct one for the combination card 27 (opening 30) and the ball is not allowed to pass through the opening 30 (FIG. 3) and is directed instead onto a chute 45 where it is fed onto return chute 46 and to the base of the ball lift 47. The ball lift 47 has an elongated slot 48 in the housing as shown in FIG. 2 having a lifting handle 50 supporting a lifting platform 51 which raises the ball on the platform within a channel member 59 until it reaches the chute 42 (in FIG. 5) where it is dropped onto the chute 42 and into the first rounded raceway 34.

Figure 6:
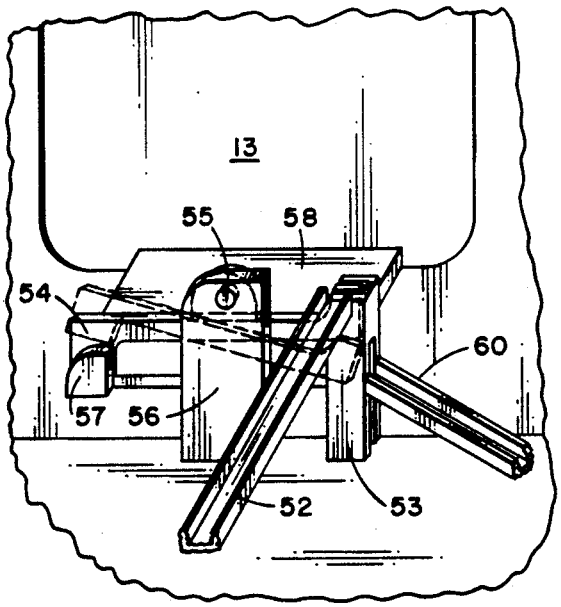
FIG. 6 is a perspective view of the unlocking mechanism for unlocking the safe door of FIG. 1.
Figure 7:
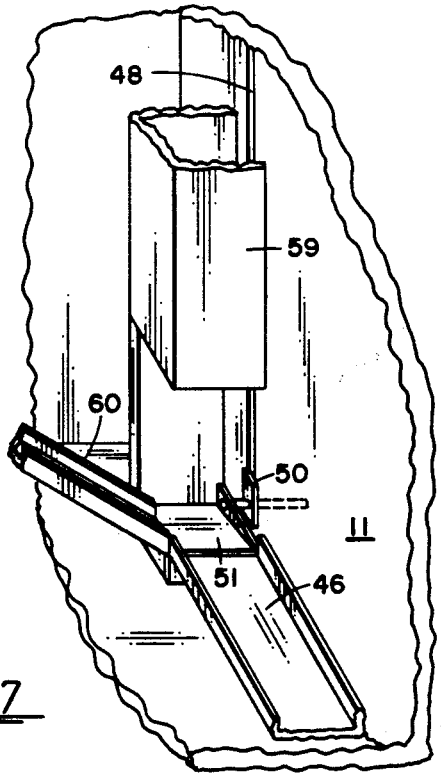
FIG. 7 is a partial perspective view of the ball lift mechanism in accordance with the game of FIGS. 1, 2 and 5.

If all three correct combinations are selected with the dial 16, 17 and 18, the ball will progress through the chutes 41 (for each dial 16 then 17 and then 18) and through the correct chute 43 passing through each of the three combinations and onto a chute 52 which will then fall into a channel 53, as seen in FIGS. 5 and 6, where it will push a lever arm 54 down. The lever arm 54 is pinned with a pin 55 to a fulcrum member 56 which raises a member 54 above the locating plate 57 to release or unlock the door 13 of FIG. 1. Raising of the lever member 54, as shown in FIG. 6, removes a portion of the lever member 54 from blocking the plate 58 so that the door 13 can be opened. Once the door 13 is opened, the ball is released into the chute 60 and returns back to the base of the ball lift 47. The safe door 13 can then be closed and a new combination set within the game using the combination cards 27 inserted as in FIG. 2. The players can then begin by selecting digits from the dial 16, 17 and 18 to try to determine the correct combination to unlock the safe.

It should be clear at this time that a combination guessing game has been provided which advantageously allows the combination to be set without the players knowing the combination and which game operates on balls moving down tracks or ball chutes through a series of combination chutes selected from a plurality of chutes. However, it should also be clear that the present invention is not to be considered limited to the forms shown which are to be considered illustrative rather than restrictive.

I claim:

1. A combination game apparatus comprising:

a housing;

combination input means including a plurality of settable input members each having indicia displayed thereon;

output means for indicating when a correct input combination has been set on said settable input members;

combination setting means for changing the combination, said combination setting means including a plurality of input members each having a combination setting thereon and a plurality of covering sleeves one covering each input member for insertion of said combination setting means into same game apparatus from said covering sleeve whereby the combination setting means can set the combination without a player seeing the combination.

2. A combination game apparatus in accordance with claim 1 in which said combination setting means includes a flat card having at least one hole therethrough.

3. A combination game apparatus in accordance with claim 2 in which said combination setting means includes a flat covering sleeve having notches therein on one end thereof for holding said flat card therein.

4. A combination game apparatus in accordance with claim 3 in which said flat covering sleeve is shaped to fit over a slot in said housing to align said flat card with said slot whereby releasing said flat card in said flat covering sleeve will insert said flat card into said slot.

5. A combination game apparatus in accordance with claim 4 having a ball and in which said combination setting means flat card slides in front of a plurality of ball chutes with an opening in said flat card in alignment with one of said plurality of ball chutes in position to allow a ball to roll through said opening in the flat card only when the ball is in the correct ball chute aligned with the opening in the combination setting means flat member opening.

6. A combination game apparatus in accordance with claim 5 in which said combination input means are rotatable dials coupled to a rotating ball raceway having an opening therein to allow a ball to pass therethrough onto one of said plurality of ball chutes when said dial is rotated to align the opening in said ball raceway with one of said plurality of ball chutes.

7. A combination game apparatus in accordance with claim 6 in which including ball lift means for raising a ball to a starting point to reset said game apparatus by lifting ball into said ball raceway.

8. A combination game apparatus in accordance with claim 7 in which said ball is directed by said ball chutes to the bottom of ball lift means with either the right or wrong combination being set.

9. A combination game apparatus in accordance with claim 8 in which said output means has locking door which is opened by correct combination of dials.

10. A combination game apparatus in accordance with claim 9 in which said ball lift means includes an elongated slot in said housing and a ball lift member slidably mounted in said slot with a ball platform on the inside of said housing and a sliding handle on the outside whereby lifting said handle in said slot raises a ball on said platform to a starting position.

11. A combination game apparatus in accordance with claim 10 in which said housing has the appearance of safe with a door unlocked by selecting the correct combination.

12. A combination game apparatus comprising:

a housing;

combination input means including a plurality of settable input members each having indicia displayed thereon and each having an opening therein in a predetermined location;

output means for indicating when a correct input combination has been set on said settable input members;

a ball;

a combination setting means for changing the combination, said combination setting means having a plurality of settable dials, and a ball track with an opening therein connected to each settable dial and rotatable to align said opening in the ball track with one of a plurality of ball chutes to allow said ball to pass onto one of the plurality of ball chutes, only one of which chutes being aligned with the combination of aid combination setting means whereby the combination guessing game has one correct chute of a plurality of ball chutes which determines the correct combination.

13. A combination game apparatus in accordance with claim 12 in which said combination setting means includes a flat member having an opening therethrough located in a predetermined position in alignment with one of said plurality of ball chutes to allow a ball to pass therethrough only when a ball dropped in the aligned ball chute from the ball track opening.

14. A combination game apparatus in accordance with claim 13 in which said combination input means includes a plurality of settable dials coupled to said rotating ball track having an opening therein to allow a ball to pass therethrough onto one of said plurality of ball chutes when one said dial is rotated to align the opening in said disk to allow the ball to pass.

15. A combination game apparatus in accordance with claim 14 including ball lift means to reset game by lifting and depositing a ball into a ball track.

16. A combination game apparatus in accordance with claim 15 in which said ball chutes are positioned to direct a ball to bottom of said lift means.

17. A combination game apparatus in accordance with claim 16 in which said output means has locking door which is opened by a correct combination of dials.

18. A combination game apparatus in accordance with claim 17 in which said ball lift means includes an elongated slot in said housing and a ball lift member on the inside of said housing and a handle protruding through said slot whereby the handle can be raised to lift ball to a starting ball track.

19. A combination game apparatus in accordance with claim 18 in which said game apparatus housing resembles a safe with rotating safe handle on a door.

* * * * *